US009152091B2

(12) United States Patent
Nakatsuhara et al.

(10) Patent No.: US 9,152,091 B2
(45) Date of Patent: Oct. 6, 2015

(54) TRANSFER DEVICE AND IMAGE FORMING APPARATUS FOR SUPPRESSING IMAGE DEFECTS OCCURRING IN AN IMAGE TRANSFER

(71) Applicant: FUJI XEROX CO., LTD., Minato-ku, Tokyo (JP)

(72) Inventors: Masaya Nakatsuhara, Kanagawa (JP); Takaharu Nakajima, Kanagawa (JP); Sho Watanabe, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 89 days.

(21) Appl. No.: 14/040,050

(22) Filed: Sep. 27, 2013

(65) Prior Publication Data

US 2014/0248068 A1 Sep. 4, 2014

(30) Foreign Application Priority Data

Mar. 1, 2013 (JP) ..... 2013-040275

(51) Int. Cl.
*G03G 15/16* (2006.01)

(52) U.S. Cl.
CPC ..... *G03G 15/1605* (2013.01); *G03G 15/167* (2013.01)

(58) Field of Classification Search
CPC ..... G03G 15/1605; G03G 15/1615
USPC ..... 399/44, 302
See application file for complete search history.

(56) References Cited

U.S. PATENT DOCUMENTS

| | | | | |
|---|---|---|---|---|
| 7,502,583 | B2 * | 3/2009 | Sawai et al. | 399/302 |
| 8,909,121 | B2 * | 12/2014 | Nishisaka et al. | 399/345 |
| 2011/0026954 | A1 * | 2/2011 | Kishi | 399/44 |

FOREIGN PATENT DOCUMENTS

| | | | |
|---|---|---|---|
| JP | 2012-008561 | A | 1/2012 |
| JP | 2012-093593 | A | 5/2012 |

* cited by examiner

*Primary Examiner* — Quana M Grainger
(74) *Attorney, Agent, or Firm* — Sughrue Mion, PLLC

(57) ABSTRACT

A transfer device includes an intermediate transfer belt that is stretched by multiple rollers, and transports a toner image on an outer peripheral surface, a second transfer member that performs second transfer that transfers the toner image to a recording medium at a second transfer position, an opposed member that abuts an inner peripheral surface of the intermediate transfer belt, and is opposed to the second transfer member at the second transfer position, and an abutment member that is rotatably arranged so as to contact the inner peripheral surface of the intermediate transfer belt at a contact point, the contact point being located on the second transfer member side of a region defined by an imaginary line extended orthogonally to an imaginary normal, the imaginary normal connecting a center of the opposed member and a center of the second transfer member at the second transfer position.

6 Claims, 4 Drawing Sheets

TRANSFER DEVICE AND IMAGE FORMING APPARATUS FOR SUPPRESSING IMAGE DEFECTS OCCURRING IN AN IMAGE TRANSFER

CROSS-REFERENCE TO RELATED APPLICATIONS

This application is based on and claims priority under 35 USC 119 from Japanese Patent Application No. 2013-040275 filed Mar. 1, 2013.

BACKGROUND

Technical Field

The present invention relates to a transfer device and an image forming apparatus.

SUMMARY

According to an aspect of the invention, there is provided a transfer device including an intermediate transfer belt that is stretched by multiple rollers, the intermediate transfer belt transporting a toner image on an outer peripheral surface, a second transfer member that performs second transfer, the second transfer transferring the toner image on the intermediate transfer belt to a recording medium at a second transfer position where the second transfer member is opposed to the intermediate transfer belt, an opposed member that abuts against an inner peripheral surface of the intermediate transfer belt, the opposed member being opposed to the second transfer member at the second transfer position, and an abutment member that is located upstream of the second transfer position with respect to a movement direction of the intermediate transfer belt, the abutment member being rotatably arranged so as to contact the inner peripheral surface of the intermediate transfer belt at a contact point, the contact point of the abutment member with the inner peripheral surface of the intermediate transfer belt being located on the second transfer member side of a region defined by an imaginary line extended in a direction orthogonal to an imaginary normal, the imaginary normal being drawn to connect a center of the opposed member and a center of the second transfer member at the second transfer position.

BRIEF DESCRIPTION OF THE DRAWINGS

Exemplary embodiment of the present invention will be described in detail based on the following figures, wherein.

DETAILED DESCRIPTION

Next, the present invention will be described in further detail with reference to the figures, by way of its exemplary embodiment and specific examples. However, the present invention is not limited to the exemplary embodiment and specific examples.

It should be noted that in the following description made with reference to the figures, the figures are for illustrative purposes only, and the ratios among various dimensions and the like differ from the actuality. For the ease of understanding, components other than those required for explanation are not illustrated as appropriate.

Figure 1:
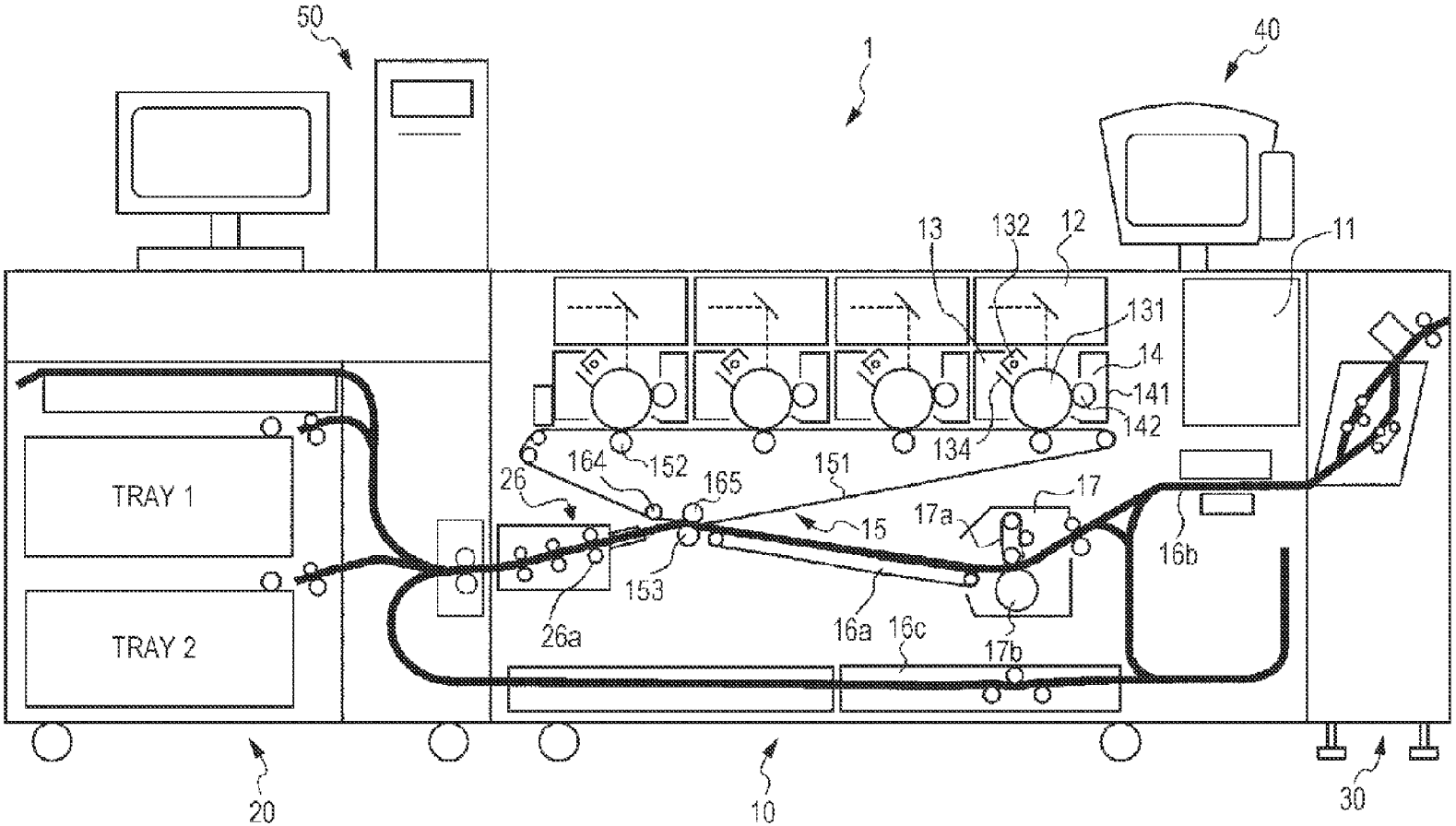
FIG. 1 is a schematic cross-sectional view illustrating an example of a general configuration of an image forming apparatus.

(1) Overall Configuration and Operation of Image Forming Apparatus (1.1) Overall Configuration of Image Forming Apparatus FIG. 1 is a schematic cross-sectional view illustrating an example of a general configuration of an image forming apparatus 1 according to an exemplary embodiment of the present invention.

The image forming apparatus 1 includes an image forming unit 10, a paper feed device 20 that is mounted to one end of the image forming unit 10, a paper output unit 30 that is provided at the other end of the image forming unit 10 and from which printed paper is output, an operational information unit 40, and an image processing unit 50 that generates image information from print information transmitted from a host apparatus.

The image forming unit 10 includes a system controller 11, an exposure device 12, photoconductor units 13, developing devices 14, a transfer device 15, paper transport devices 16*a*, 16*b*, and 16*c*, a fixing device 17, and a driving device 18. The image forming unit 10 forms image information received from the image processing unit 50, as a toner image on paper P fed from the paper feed device 20.

The paper feed device 20 supplies paper to the image forming unit 10. That is, the paper feed device 20 includes multiple paper loading units that receive different types (for example, material, thickness, paper size, and paper grain) of paper P. The paper feed device 20 supplies the paper P sent out from one of these multiple paper loading units to the image forming unit 10.

The paper output unit 30 outputs the paper P to which an image has been outputted in the image forming unit 10. For this reason, the paper output unit 30 is provided with an output paper receiving unit to which the paper P that has undergone image output is output. The paper output unit 30 may have the function of performing post-processing such as cutting or stapling on a bundle of paper outputted from the image forming unit 10.

The operational information unit 40 is used for inputting various settings and instructions, and displaying information. That is, the operational information unit 40 corresponds to a so-called user interface. Specifically, the operational information unit 40 is configured by a combination of a liquid crystal display panel, various operating buttons, a touch panel, and the like.

(1.2) Configuration and Operation of Image Forming Unit

In the image forming apparatus 1 configured as described above, in synchronism with the timing of image formation, each single sheet of the paper P to be printed by a print job sent out from a specified paper loading unit of the paper feed device 20 is fed to the image forming unit 10.

The photoconductor units 13 are provided in parallel below the exposure device 12. Each of the photoconductor units 13 includes a photoconductor drum 131. The photoconductor drum 131 serves as an image carrier that is rotationally driven. A charger 132, the exposure device 12, the developing device 14, a first transfer roller 152, and a cleaning blade 134 are arranged along the rotational direction of the photoconductor drum 131.

Each of the developing devices 14 has a developing housing 141 in which a developer is received. A developing roller 142 opposed to the photoconductor drum 131 is disposed inside the developing housing 141. A layer regulating member (not illustrated) that regulates the layer thickness of developer is arranged in close proximity to the developing roller 142.

The developing devices 14 are configured in substantially the same manner except for the developer received in the corresponding developing housing 141. The developing devices 14 form toner images of yellow (Y), magenta (M), cyan (C), and black (B), respectively.

The surface of the photoconductor drum 131 that rotates is charged by the charger 132. An electrostatic latent image is formed on the surface of the photoconductor drum 131 by latent image-forming light emitted from the exposure device 12. The electrostatic latent image formed on the photoconductor drum 131 is developed as a toner image by the developing roller 142.

The transfer device 15 includes an intermediate transfer belt 151, the first transfer roller 152, and a second transfer roller 153. Toner images of various colors formed on the photoconductor drums 131 of the respective photoconductor units 13 are transferred to the intermediate transfer belt 151 in multiple layers. The first transfer roller 152 sequentially transfers the toner images of various colors formed in the photoconductor units 13 to the intermediate transfer belt 151 (first transfer). The second transfer roller 153 transfers the toner images of various colors that have been transferred onto the intermediate transfer belt 151 in a superimposed manner, to the paper P as a recording medium at once (second transfer).

The toner images of various colors formed on the photoconductor drums 131 of the respective photoconductor units 13 are electrostatically transferred onto the intermediate transfer belt 151 sequentially (first transfer) by the first transfer roller 152 to which a predetermined transfer voltage is applied from a power supply device (not illustrated) controlled by the system controller 11, thereby forming superimposed toner images on which various colors of toner are superimposed.

As the intermediate transfer belt 151 moves, the superimposed toner images on the intermediate transfer belt 151 are transported to a region (second transfer part TR) where the second transfer roller 153 is arranged. Once the superimposed toner images are transported to the second transfer part TR, the paper P is supplied to the second transfer part TR from the paper feed device 20 in synchronism with this timing. Then, a predetermined transfer voltage is applied to the backup roller 165 that is opposed to the second transfer roller 153 with the intermediate transfer belt 151 therebetween, from the power supply device or the like controlled by the system controller 11, and the multilayer toner images on the intermediate transfer belt 151 are transferred onto the paper P at once.

Residual toner on the surface of the photoconductor drum 131 is removed by the cleaning blade 134, and recovered to a waste toner receiving unit (not illustrated). The surface of the photoconductor drum 131 is charged by the charger 132 again.

The fixing device 17 includes an endless fixing belt 17*a* that rotates in one direction, and a pressure roller 17*b* that contacts the peripheral surface of the fixing belt 17*a* and rotates in one direction. A nip part (fixing region) is formed by the press contact region between the fixing belt 17*a* and the pressure roller 17*b*.

The paper P with the toner image transferred in the transfer device 15 is transported to the fixing device 17 via the paper transport device 16*a* in a state in which the toner image has not been fixed yet. The toner image is fixed onto the paper P transported to the fixing device 17 with pressure and heat applied by the pair of the fixing belt 17*a* and the pressure roller 17*b*.

The paper P with the fixed toner image is fed to the paper output unit 30 via the paper transport device 16*b*.

In the case of outputting an image onto both sides of the paper P, the front and back sides of the paper P are reversed by the paper transport device 16*c*, and the paper P is fed to the second transfer part TR of the image forming unit 10 again. Then, after a toner image is transferred and the transferred image is fixed onto the paper P, the paper P is fed to the paper output unit 30. The paper P fed to the paper output unit 30 undergoes post-processing such as cutting or stapling as required, before being output to the output paper receiving unit.

Figure 2:
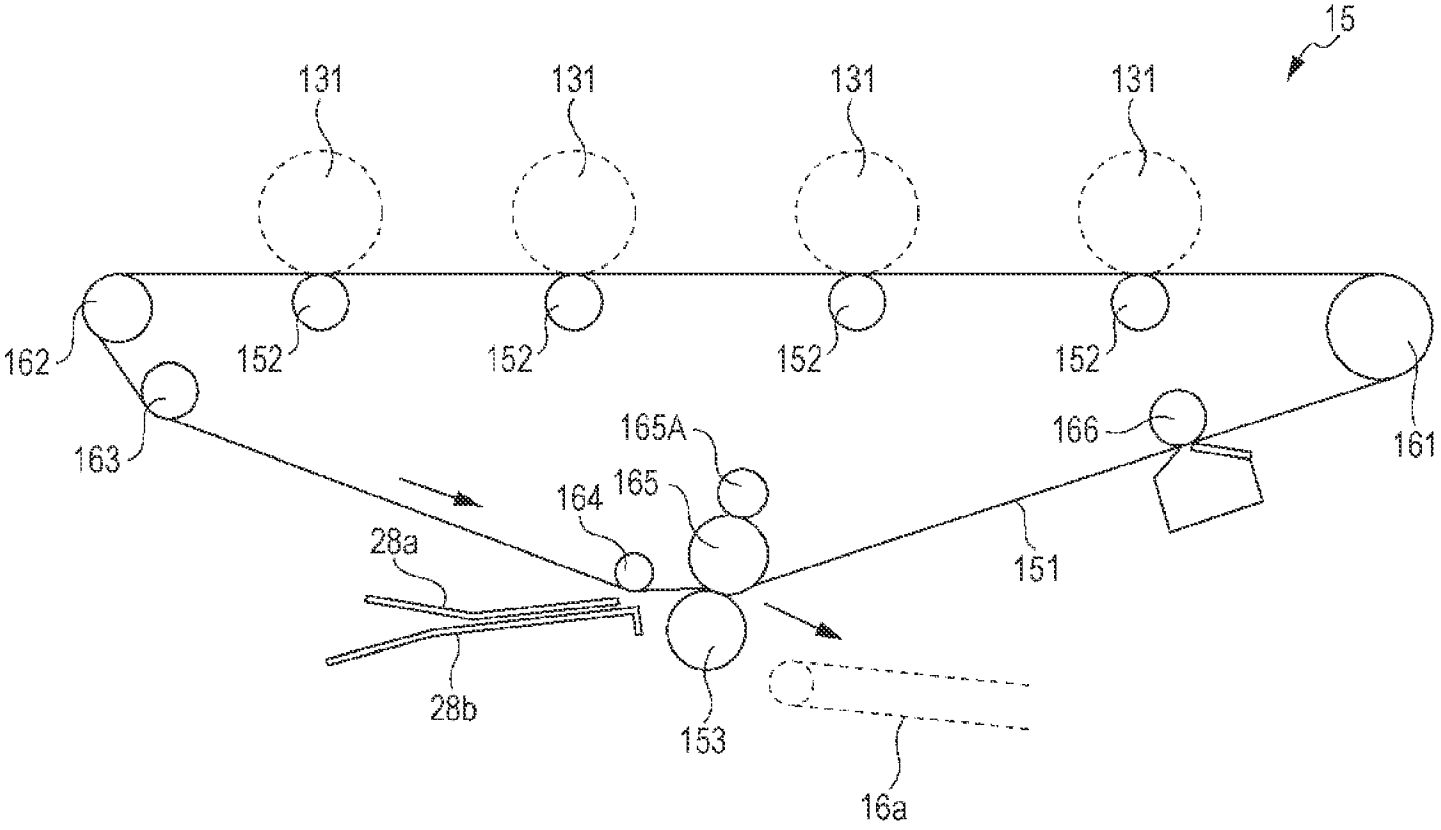
FIG. 2 is a schematic cross-sectional view illustrating a configuration of a transfer device of the image forming apparatus.

(2) Configuration and Action of Transfer Device (2.1) Configuration of Transfer Device FIG. 2 is a schematic cross-sectional view illustrating a configuration of the transfer device 15 of the image forming apparatus 1 according to the exemplary embodiment.

The transfer device 15 includes the intermediate transfer belt 151, the first transfer roller 152, and the second transfer roller 153.

The intermediate transfer belt 151 used is made of resin such as polyimide or polyamide containing a suitable amount of conductive agent such as carbon black, and has a volume resistivity of $10^6$ to $10^{14}$ Ω·cm. The intermediate transfer belt 151 is formed as an endless belt in a film-like form with a thickness of, for example, about 0.1 mm.

The intermediate transfer belt 151 has a driving roller 161, a driven roller 162, a tension roller 163, a support roller 164, the backup roller 165, and a cleaning backup roller 166. The driving roller 161 drives the intermediate transfer belt 151 so as to circulate. The driven roller 162 supports the intermediate transfer belt 151 that extends in a substantially straight line along the arrangement direction of the photoconductor drums 131. The tension roller 163 applies a predetermined tension to the intermediate transfer belt 151 and prevents meandering of the intermediate transfer belt 151. The support roller 164 serves as an abutment member that is rotatably arranged in contact with the inner peripheral surface of the intermediate transfer belt on the upstream side of the second transfer part TR. The backup roller 165 is provided in the second transfer part TR. The cleaning backup roller 166 is provided in a cleaning part that scrapes off residual toner on the intermediate transfer belt 151.

The backup roller 165 is a blended rubber tube of EPDM and NBR with carbons dispersed on its surface. The inside of the backup roller 165 is made of EPDM rubber. The backup roller 165 has a surface resistivity of $10^7$ to $10^{10}$ Ω/sq and a roller diameter of 28 mm. The hardness of the backup roller 165 is set to, for example, 70 degrees (Asker-C).

The backup roller 165 is arranged on the back side of the intermediate transfer belt 151, and forms a counter electrode for the second transfer roller 153. A power supply roller 165A made of metal is arranged in contact with the backup roller 165. The power supply roller 165A applies a bias voltage for forming a second transfer electric field in the second transfer part TR.

The first transfer roller 152 is opposed to each of the photoconductor drums 131 with the intermediate transfer belt 151 therebetween. The first transfer roller 152 is applied with a voltage of a polarity opposite to the polarity in which toner is charged. Consequently, toner images on the photoconductor drums 131 are electrostatically transferred to the intermediate transfer belt 151 sequentially, thereby forming superimposed toner images on the intermediate transfer belt 151.

The second transfer roller 153 is made of semi-conductive rubber with a volume resistivity of $10^6$ to $10^{10}$ Ω·cm and a hardness of 40 degrees or more (Asker-C). The second transfer roller 153 is opposed to the backup roller 165 with the intermediate transfer belt 151 therebetween. The second transfer roller 153 forms the second transfer part TR together with the backup roller 165 where a toner image carried by the intermediate transfer belt 151 is transferred to the paper P being transported on the second transfer roller 153.

In the second transfer part TR, the backup roller 165 is urged toward the second transfer roller 153 via the intermediate transfer roller 151, in a constant displacement state according to the basis weight of the paper P. A nip part is formed over a predetermined width between the second transfer roller 153 and the backup roller 165 (second pressing region).

In the nip part, a normal N to the transfer nip (hereinafter simply referred to as "transfer nip normal N") formed by the backup roller 165 and the second transfer roller 153 is moved (offset) with respect to an imaginary line L connecting the center B of the backup roller 165 and a point A at which the intermediate transfer belt 151 begins its contact with the peripheral surface of the backup roller 165, with the center B of the backup roller 165 as a starting point, thereby securing the contact width of the contact region between the intermediate transfer belt 151 and the second transfer roller 153.

The support roller 164 as an example of abutment member is rotatably arranged in contact with the inner peripheral surface of the intermediate transfer belt 151, on the upstream side of the second transfer roller 153 with respect to the paper transport direction.

Further, the contact point of the support roller 164 with the inner peripheral surface of the intermediate transfer belt 151 is located on the second transfer roller 153 side of a region defined by an imaginary line that is extended in the direction orthogonal to the transfer nip normal N formed by the backup roller 165 and the second transfer roller 153.

As a result, between the support roller 164 and the second transfer roller 153, the width of contact of the intermediate transfer belt 151 and the second transfer roller 153 is increased to the upstream side in the paper transport direction (first pressing region).

A paper guide 28 is arranged on the upstream side of the second transfer part TR of the transfer device 15. The paper guide 28 is opposed to the toner image-carrying surface of the intermediate transfer belt 151, and guides the paper P to the second transfer part TR.

The paper guide 28 includes a paper guide 28*a* that guides the upper surface (transfer surface) of the paper P, and a paper guide 28*b* that guides the lower surface (non-transfer surface) of the paper P.

(2.2) Action of Transfer Device

Figure 3:
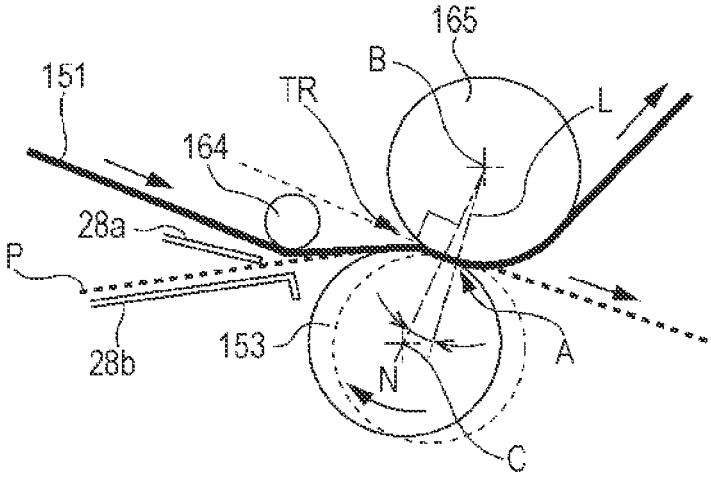
FIG. 3 is a schematic cross-sectional view of the major portion of the transfer device including a paper guide of the image forming apparatus.

FIG. 3 is a schematic cross-sectional view of the major portion of the transfer device 15 including the paper guide 28 of the image forming apparatus 1 configured as mentioned above.

Hereinafter, the action of the transfer device 15 will be described with reference to FIG. 3.

A toner image formed on the photoconductor drum 131 of each of the photoconductor units 13 is transferred onto the intermediate transfer belt 151 in a first transfer part where each of the photoconductor drums 131 and the intermediate transfer belt 151 are opposed to each other. The unfixed toner image that has undergone the first transfer is transported to the second transfer part TR as the intermediate transfer belt 151 rotates.

The paper feed device 20 supplies the paper P of a predetermined size in synchronism with the timing of image formation. After the paper P supplied by the paper feed device 20 is temporarily stopped by an orientation correcting unit 26, registration rollers 26*a* are rotated in synchronism with the movement timing of the intermediate transfer belt 151 carrying the toner image, thereby performing registration of the toner image in the feed direction of the paper P.

Then, the paper P transported in a synchronized manner is nipped in the second transfer part TR formed between the intermediate transfer belt 151 and the second transfer roller 153. The power supply roller 165A forms a transfer electric field by applying a voltage of the same polarity as the polarity in which toner is charged. The transfer electric field thus formed causes the unfixed toner image carried on the intermediate transfer belt 151 to be electrostatically transferred to the paper P in the second transfer part TR.

Thereafter, the paper P with the electrostatically transferred toner image is transported by the paper transport device 16*a* provided on the downstream side of the transport direction. The paper transport device 16*a* transports the paper P to the fixing device 17 at a speed suited to a fixing process in the fixing device 17. The fixing device 17 performs a fixing process by application of heat and pressure, thereby fixing the unfixed toner image on the paper P onto the paper P. Then, the paper P with the fixed image is output to the paper output unit 30 by the paper transport device 16*a*. Residual toner that remains on the intermediate transfer belt 151 after transfer of the image to the paper P is finished is removed by a belt cleaner.

(2.3) Image Disturbance

In the image forming apparatus 1, not only general copy papers but various papers are used. For applications aimed at vendors handling on-demand publications such as publishing and advertising services, toner images are formed on a wide variety of papers such as woodfree paper, wood-containing paper, coated paper, and art paper.

In particular, in a case where a piece of coated paper for offset printing with a basis weight of 200 g/$m^2$ or less and whose surface has been applied with a coating to improve smoothness is used as the paper P, an image disturbance can occur owing to the characteristics of the paper. In addition, with the recent trend toward higher speed and higher image quality, an image disturbance is particularly liable to occur in a case where the process speed exceeds 400 mm/sec, for example.

Figure 5A:
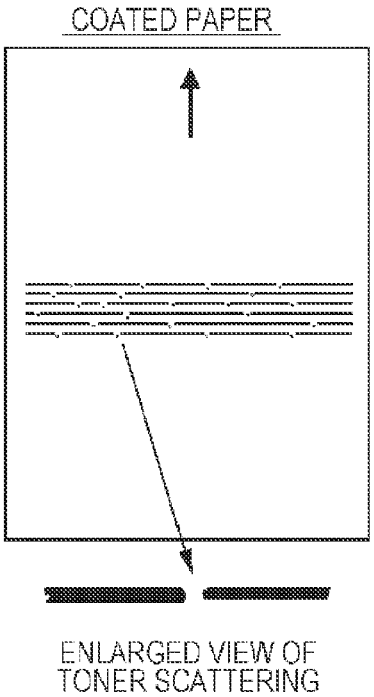
FIGS. 5A and 5B are schematic diagrams each illustrating an example of the image defect to be addressed by an exemplary embodiment of the present invention.

In a case where the paper P used is a piece of coated paper whose surface has been applied with a coating to improve smoothness, the following image defect occurs in some cases. That is, toner scatters backwards in the travelling direction of the paper P immediately before entering the second pressing region where the second transfer roller 153 and the backup roller 165 are strongly pressed against each other at the second transfer position (see FIG. 5A). Such an image defect tends to occur in a case where the toner image to be formed includes multiple thin lines running at right angles to the travelling direction of the paper P.

Figure 6:
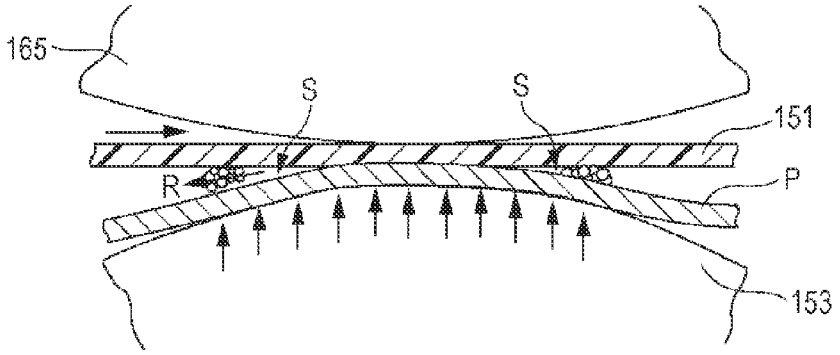
FIG. 6 is a schematic diagram for explaining the probable cause of the image defect to be addressed by the exemplary embodiment of the present invention.

On the upstream side of the second transfer position with respect to the paper transport direction, the intermediate transfer belt 151 and the paper P are laid over each other as illustrated in FIG. 6, and the back surface of the paper P comes into contact with the second transfer roller 153. At this time, toner on the intermediate transfer belt 151 becomes lodged in between the intermediate transfer belt 151 and the paper P, and a space S is formed between thin lines of toner located on the forward side and thin lines of toner located on the backward side.

When the paper P enters the second pressing region where the second transfer roller 153 and the backup roller 165 are strongly pressed against each other at the second transfer position, this space S is crushed from the forward side by a large pressing force exerted at this time. In the case of an image including multiple thin lines running at right angles to the travelling direction of the paper P, for example, the air within the space S becomes confined, making it difficult for a discharge path for the confined air to form.

Consequently, when the space S is crushed from the forward side, as indicated by an arrow R in FIG. 6, a group of toner particles forming thin lines on the backward side where the pressing force is weak is blown away by the air pressure, and thus the air within the space S is released to the backward side. It is assumed that toner forming thin lines on the backward side is thus scattered backwards.

Accordingly, by offsetting the second transfer roller 153 to the upstream side in the paper transport direction (direction that intersects the transfer nip normal N), the width of contact between the intermediate transfer belt 151 and the second transfer roller 153 on the upstream side in the paper transport direction of the second transfer position is increased. As a result, a force that constrains toner lodged in between the intermediate transfer belt 151 and the paper P is generated, thereby keeping toner from scattering backwards in the travelling direction immediately before entering the second pressing region.

Figure 5B:
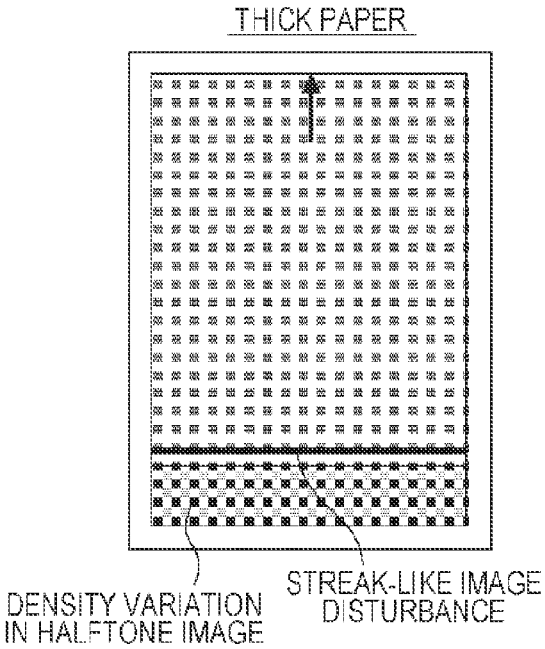

When the trailing edge of the paper P passes the distal end of the paper guide 28*a* that guides the upper surface (transfer surface) of the paper P, a force is applied to the paper P in the direction of the transfer nip normal N. In a case where the paper used is a piece of thick paper with a basis weight of 300 $g/m^2$ to 450 $g/m^2$ and thus has increased stiffness, the force acting in the direction of the transfer nip normal N becomes an impact force when the trailing edge collides against the surface of the intermediate transfer belt 151, causing the intermediate transfer belt 151 to vibrate so as to be displaced at right angles to the peripheral surface. It is assumed that such vibration is transmitted to the second transfer position, causing a streak-like image disturbance to occur in the image being transferred in some cases (see FIG. 5B).

In a case where the offset is reduced to reduce the force acting in the direction of the transfer nip normal N of the paper P in order to reduce such a streak-like image disturbance, there is a problem in that an image defect in which toner scatters backwards becomes more liable to occur.

(2.4) Action/Effect of First Pressing Region

Figure 4:
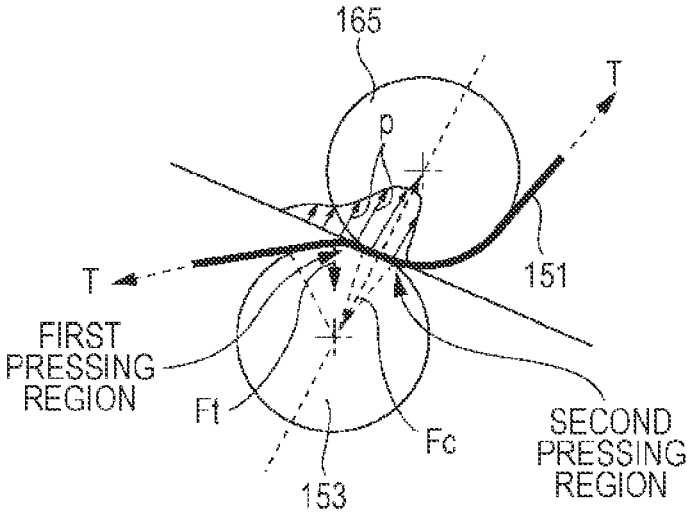
FIG. 4 illustrates pressing forces (Fc and Ft) and the pressure distribution in a paper transport direction of a peak pressure (p) in a second transfer part.

FIG. 4 illustrates pressing forces (Fc and Ft) and the pressure distribution in the paper transport direction of a peak pressure (p), in the second transfer part TR formed by the second transfer roller 153 and the backup roller 165 that are in press contact with each other with the intermediate transfer belt 151 therebetween, and the intermediate transfer belt 151 that is applied with a tension T by the support roller 164 and wrapped around the second transfer roller 153.

Hereinafter, the pressing forces in the second transfer part TR of the transfer device 15 according to the exemplary embodiment will be described with reference to FIG. 4.

In the transfer device 15 according to the exemplary embodiment, on the upstream side of the second transfer roller 153 in the paper transport direction, the support roller 164 is rotatably arranged in contact with the inner peripheral surface of the intermediate transfer belt 151. Further, the contact point of the support roller 164 with the inner peripheral surface of the intermediate transfer belt 151 is located on the second transfer roller 153 side of a region defined by an imaginary line that is extended in the direction orthogonal to the transfer nip normal N formed by the backup roller 165 and the second transfer roller 153.

As a result, the first pressing region is formed on the upstream side in the paper transport direction of the second pressing region that is formed by press contact between the second transfer roller 153 and the backup roller 165. In the first pressing region, the backup roller 165 and the second transfer roller 153 are not in press contact with each other, and mostly the intermediate transfer belt 151 and the second transfer roller 153 are in contact with each other.

In the first pressing region, on the upstream side in the paper transport direction of the second transfer part TR, the intermediate transfer belt 151 stretched under a predetermined tension applied by the tension roller 163 is applied with an addition tension by the support roller 164, and a pressing force Ft based on the tension on the intermediate transfer belt 151 is exerted.

In the second pressing region, the second transfer roller 153 is applied with a constant load and pressed toward the backup roller, causing a pressing force Fc to be exerted.

These pressing forces are set as follows: $|Ft|<|Fc|$. That is, the pressing force Ft in the first pressing region is set lower than the pressing force Fc in the second pressing region.

Because the pressing force Ft acts in the first pressing region, the pressing force Fc in the second pressing region can be set lower than that in a case where the first pressing region is not formed.

The second transfer roller 153 is formed so as to have a hardness higher than or equal to 40 degrees (Asker-C). Consequently, the pressing force Ft based on the tension on the intermediate transfer belt 151 is exerted in a stable manner, thereby securing the pressing force in the first pressing region.

Because the hardness of the backup roller 165 is set to 70 degrees (Asker-C), a pressing force required for second transfer is secured in the second pressing region.

In a case where the first pressing region and the second pressing region are unnecessarily spaced apart from each other, a region where peak pressure drops is created between the first pressing region and the second pressing region. Consequently, when the toner image carried on the intermediate transfer belt 151 passes the pressing regions, an abrupt drop and rise in peak pressure may occur in the space S mentioned above, causing the carried toner layer to break down.

In the transfer device 15 according to the exemplary embodiment, the imaginary line connecting the center of the backup roller 165 and the center C of the second transfer roller 153 lies within the first pressing region where the intermediate transfer belt 151 and the second transfer roller 153 contact each other. Therefore, an abrupt drop in pressing force does not occur between the first pressing region and the second pressing region.

As a result, the width of contact between the intermediate transfer belt 151 and the second transfer roller 153 is increased to the upstream side in the paper transport direction, thus generating a force that constrains the toner lodged in between the intermediate transfer belt 151 and the paper P in the first pressing region.

That is, toner is kept from scattering backwards in the travelling direction immediately before entering the second pressing region that is a region where the second transfer roller 153 and the backup roller 165 are strongly pressed against each other at the second transfer position.

Moreover, the imaginary line connecting the center of the backup roller 165 and the center of the second transfer roller 153 lies within the first pressing region where the intermediate transfer belt 151 and the second transfer roller 153 contact each other. Therefore, the pressing force Fc between the second transfer roller 153 and the backup roller 165 in the second pressing region decreases, and less compressing force is exerted on the space S.

Therefore, occurrence of an image defect in which toner scatters backwards in the travelling direction immediately before entering the second transfer position is reduced.

While the exemplary embodiment of the present invention has been described in detail above, the present invention is not limited to the exemplary embodiment mentioned above but various modifications are possible within the scope of the present invention as defined by the claims.

For example, while in the exemplary embodiment is directed to the transfer device 15 including the second transfer roller 153 as an example of the second transfer member, the transfer device 15 may employ a belt transfer system in which the second transfer roller 153 is opposed to the backup roller 165 with a second transfer belt therebetween.

What is claimed is:

1. A transfer device comprising:

an intermediate transfer belt that is stretched by a plurality of rollers, the intermediate transfer belt configured to transport a toner image on an outer peripheral surface;

a second transfer member configured to perform second transfer, the second transfer transferring the toner image on the intermediate transfer belt to a recording medium at a second transfer position where the second transfer member is opposed to the intermediate transfer belt;

an opposed member that abuts against an inner peripheral surface of the intermediate transfer belt, the opposed member being opposed to the second transfer member at the second transfer position; and an abutment member that is located upstream of the second transfer position with respect to a movement direction of the intermediate transfer belt, the abutment member being rotatably arranged so as to contact the inner peripheral surface of the intermediate transfer belt at a contact point, the contact point of the abutment member with the inner peripheral surface of the intermediate transfer belt being located on the second transfer member side of a region defined by an imaginary line extended in a direction orthogonal to an imaginary normal, the imaginary normal being drawn to connect a center of the opposed member and a center of the second transfer member at the second transfer position, the imaginary line extending through a point between the second transfer member and the opposed member.

2. The transfer device according to claim 1, wherein the second transfer member has a hardness greater than or equal to 40 degrees in Asker-C scale.

3. The transfer device according to claim 1, wherein $|Ft|<|Fc|$, where Ft is a pressing force on the intermediate transfer belt in a first pressing region, and Fc is a pressing force on the second transfer member in a second pressing region, the first pressing region being located upstream of the second transfer position with respect to the movement direction of the intermediate transfer belt and being a region where the opposed member and the second transfer member are not in press contact with each other and the intermediate transfer belt and the second transfer member are in contact with each other, the second pressing region being a region where the opposed member and the second transfer member are in press contact with each other with the intermediate transfer belt being sandwiched between the opposed member and the second transfer member.

4. The transfer device according to claim 1, wherein the imaginary normal drawn to connect the center of the opposed member and the center of the second transfer member at the second transfer position lies within a contact region formed by surface contact made by a part of a peripheral surface of the intermediate transfer belt and a part of the second transfer member at the second transfer position.

5. An image forming apparatus comprising:

a toner image forming section that forms a toner image;

a first transfer section that transfers the toner image formed by the toner image forming section onto an intermediate transfer belt;

the transfer device according to claim 1; and a fixing section that fixes the toner image transferred to the recording medium by the transfer device.

6. The transfer device according to claim 1, wherein the imaginary line is tangent to a peripheral surface of the second transfer member.

* * * * *